United States Patent [19]

Wien et al.

[11] 4,119,935

[45] Oct. 10, 1978

[54] CIRCUIT INTERRUPTER INCLUDING LOW FRICTION LATCH

[75] Inventors: Raymond E. Wien, Penn Township, Allegheny County, Pa.; John F. Cotton, Athens, Ga.; Nicholas A. Salemi, Plum Borough, Pa.

[73] Assignee: Westinghouse Electric Corp., Pittsburgh, Pa.

[21] Appl. No.: 734,069

[22] Filed: Oct. 20, 1976

[51] Int. Cl.[2] ..... H01H 9/20

[52] U.S. Cl. ..... 335/167; 335/170; 337/70

[58] Field of Search ..... 335/21, 196, 38, 167, 335/168, 169, 170, 253, 254; 200/318; 337/70

[56] References Cited

U.S. PATENT DOCUMENTS

| | | | |
|---|---|---|---|
| 3,754,108 | 8/1973 | Marot et al. | 335/167 |
| 3,979,704 | 9/1976 | Buckley et al. | 335/196 |

*Primary Examiner*—George Harris

*Attorney, Agent, or Firm*—Robert E. Converse, Jr.

[57] ABSTRACT

A circuit interrupter including a releasable latch restrained by a stamped metal rotatable cam having a latching surface in sliding contact with the latch member. The rotatable cam is inclined at an angle to the axis of rotation so as to cause only the smooth portion of the latching surface produced by the shearing action of the stamping process to contact the latch member. The rough portion of the latching surface produced by tearing action of the stamping process is not in contact with the latch member, thereby eliminating the need for a machining operation to provide a low friction contact surface with the latch member.

13 Claims, 8 Drawing Figures

20

CIRCUIT INTERRUPTER INCLUDING LOW FRICTION LATCH

BACKGROUND OF THE INVENTION

1. Field of the Invention:

The invention relates to circuit interrupters and, more particularly, to low friction latch mechanisms.

2. Description of the Prior Art:

Circuit breakers are widely used in industrial, commercial and residential applications to provide protection for electrical apparatus and distribution circuits powering the apparatus. Stored energy operating mechanisms are usually included in such circuit interrupters to latch the contacts in the closed position during normal operation. Overload currents flowing through circuits powering the electrical apparatus are detected by various forms of current sensing devices which actuate mechanisms to release the circuit breaker latch, thereby allowing the energy stored in the operating mechanism to open the contacts of the circuit breaker and interrupt the overload current flowing through the circuit. Usually, such overload currents cause a latching surface to slide upon a latch member until the latch member is released. However, friction between the latch member and the latching surface can reduce the sensitivity and accuracy of the circuit breaker in tripping at a predetermined overload current level. It is therefore desirable to minimize friction between the latch member and latching surface.

Since circuit breakers are manufactured in high volume, it is also desirable to reduce the cost of production by stamping the various parts of the circuit breaker mechanism from sheet metal. Such a stamping operation produces a sheared surface having a smooth portion and a rough portion. The smooth portion is formed during the initial stages of the stamping operation wherein the tool performs a combination of stretching and shearing. During later stages of the stamping operation, the sheet metal is torn by the tool, thereby producing the rough surface. In order to reduce latch friction produced by this rough surface, prior art circuit breaker latching surface were smoothed with a machining operation. While this satisfactorily reduced the friction of the latching surface, it increased the cost of the circuit breaker. It would be desirable to provide a latching surface having a low-friction area of contact between the latching surface and the corresponding latch member which does not require a machining operation.

SUMMARY OF THE INVENTION

The invention provides a circuit interrupter comprising separable contacts, operating means including a releasable latch for effecting separation of the contacts upon release of the latch, and a latching surface contacting and restraining the latch. The latching surface is movable to effect release of the latch and has a rough portion and a smooth portion, the latching surface being disposed in relation to the latch member so as to cause only the smooth portion of the latching surface to contact the latch.

DESCRIPTION OF THE PREFERRED EMBODIMENT

Figure 1:
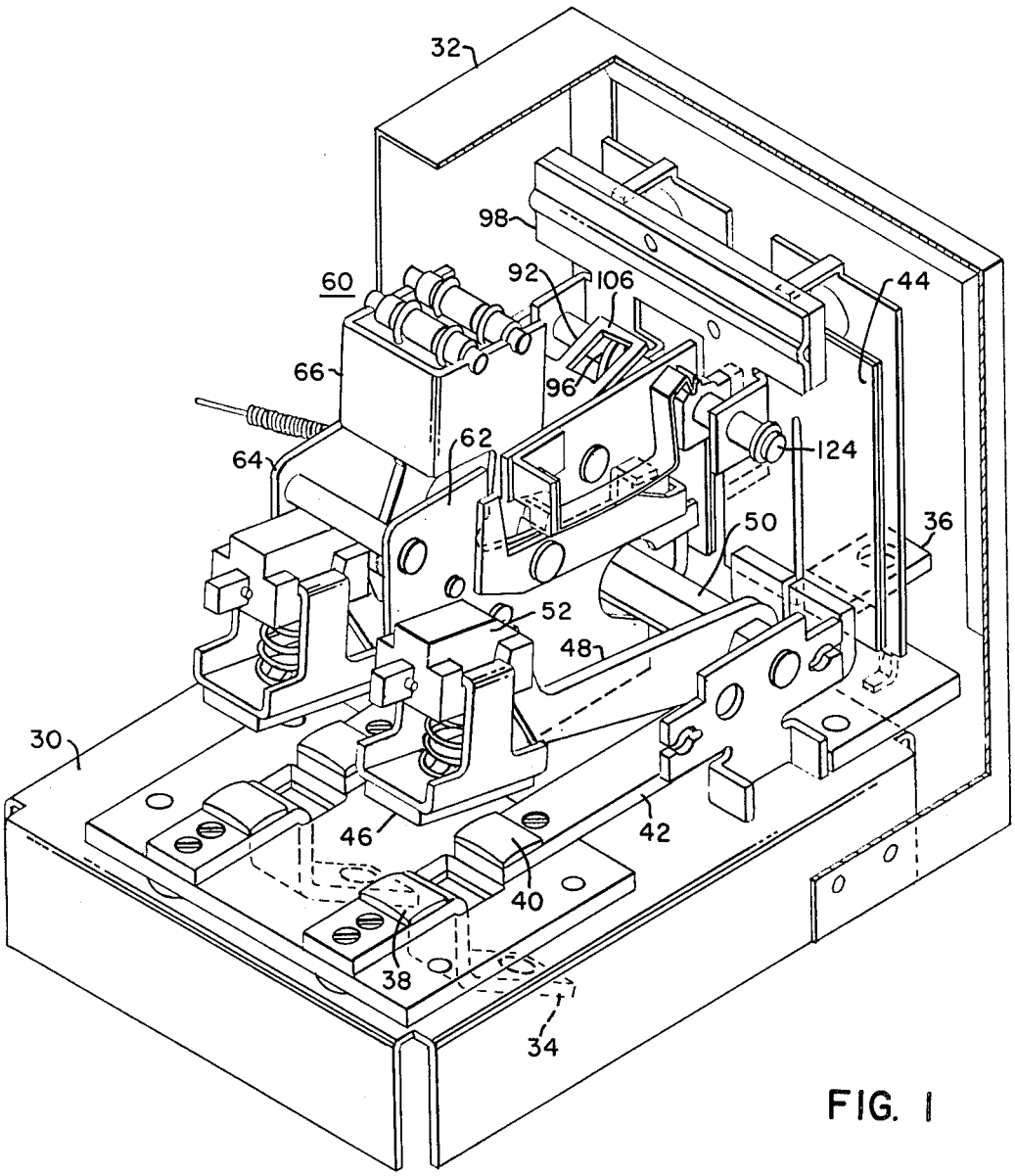
FIG. 1 is a perspective view of a circuit interrupter utilizing the teachings of the present invention.

Referring now to the drawings, in which like reference characters refer to like members, FIG. 1 shows a two-pole circuit interrupter 20 utilizing the teaching of the present invention. The circuit interrupter 20 is similar to that disclosed in copending U.S. Patent Application Ser. No. 496,800 filed Aug. 12, 1974 by John F. Cotton et al, now U.S. Pat. No. 3,983,454. Thus, portions of the circuit interrupter 20 will be only briefly described. The circuit interrupter 20 is mounted on a metallic base 30 and partially surrounded by a cover 32 to provide protection during handling. Each pole of the circuit interrupter 20 includes a terminal 36 connected to a conductor 42 which is insulatingly mounted upon the base 30. At the end opposite the terminal 36, the conductor 42 supports a fixed contact 40. Adjacent to the contact 40 is an additional fixed contact 38, supported upon a terminal 34. A movable bridging contact 46 is resiliently supported upon an insulating member 52 attached to an elongated metallic contact arm 48 which is pivotally supported upon the base 30. With the circuit interrupter 20 in a closed circuit position, the contact 46 bridges the contacts 38 and 40. An electrical circuit is thus completed from the terminal 36 through the conductor 42, the contact 40, the bridging contact 46, and the fixed contact 38 to the terminal 34. The contact arms 48 are pivotally supported upon the shaft 50 which is in turn mounted upon the base 30. Shaft 50, which can be a metallic member, connects together the elongated contact arms 48 of all poles of the circuit interrupter 20 for simultaneous movement.

A single operating mechanism 60 is provided for operating all poles of the circuit interrupter 20 and is securely attached to support base 30. Operator 60 is connected to one of the elongated contact arms 48 and, as this contact arm 48 is moved in response to the positioning of the operating mechanism 60, the other elongated contact arm 48 connected through shaft 50 also responds. The operating mechanism 60 comprises a U-shaped operating member 66, the two legs of which are pivotally connected to side plates 62 and 64. A primary latch 72 (FIG. 2) is provided and is pivotally connected to a shaft 74 disposed between side plates 62 and 64. A toggle linkage comprising toggle links 76 and 78 is provided, with one end of the linkage connected to the elongated contact arm 48 and the other end connected to primary latch 72. Multiple springs 80 are connected between the knee 82 of the toggle linkage and the top of U-shaped member 66 for raising contact arm 48 with a snap action when primary latch 72 is released. The upward force exerted by springs 80 holds the toggle linkage in engagement with a shaft 86 on primary latch 72. Releasable primary latch 72 is held in a latched position by a secondary latch member 92. Secondary latch member 92 is biased towards an unlatched position by a torsion spring 94. When secondary latch 92 moves to the unlatched position, primary latch 72 is released and rotates about shaft 74 due to the force of spring 80, collapsing the toggle linkage and raising the elongated contact arm 48.

Figure 2:
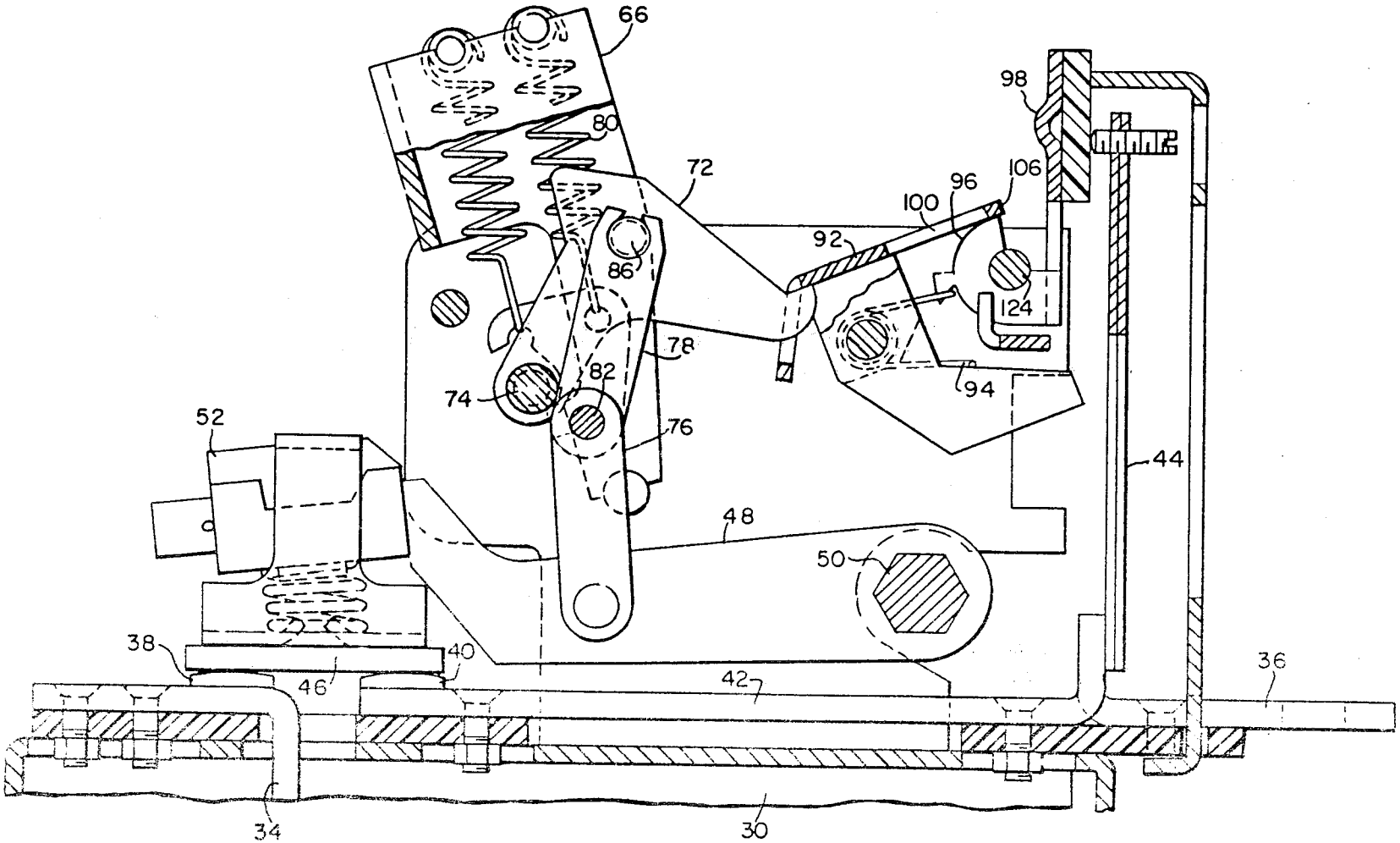
FIG. 2 is a side view of the circuit interrupter shown in FIG. 1, having portions removed for clarity, with the circuit breaker shown in the closed position.
Figure 3:
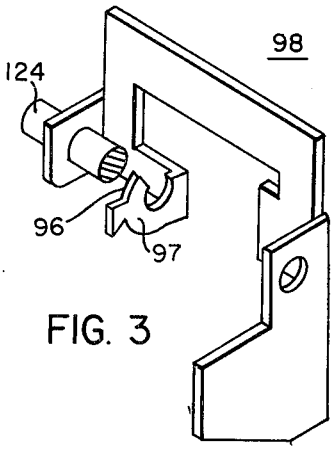
FIG. 3 is a perspective view of the sheet metal stamping of FIG. 1 which includes a latching surface.

Secondary latch 92 is prevented from moving to the unlatched position when the breaker is closed by an arcuate cam surface 96 which is part of a sheet metal stamping 98. The stamping 98, shown in perspective in FIG. 3, is pivotally supported upon the pin 124. As can be seen in FIG. 2, a portion 106 of secondary latch member 92 rest against the cam surface 96. When the stamping 98 is rotated a predetermined angle counterclockwise about a pin 124, the cam surface 96 passes through opening 100 in secondary latch member 92, permitting secondary latch member 92 to rotate to the unlatched position, thereby releasing primary latch 72 and tripping open the circuit interrupter 20. Stamping 98 is connected to be rotated by current responsive means 44 when the current through the circuit interrupter 20 exceeds a predetermined value.

Figure 4:
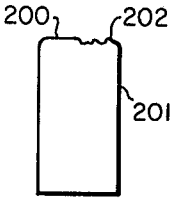
FIG. 4 is a schematic diagram of the edge of a sheet metal stamping.
Figure 5:
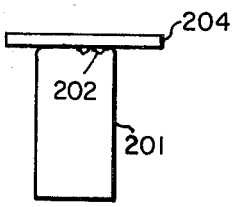
FIG. 5 is a schematic diagram illustrating the relationship between a latch member and a latching surface stamped from sheet metal with no further preparation.
Figure 6:
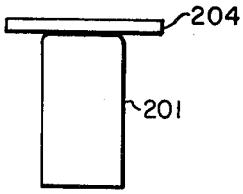
FIG. 6 is a schematic diagram showing the relationship between a latch member and a prior art stamped sheet metal latching surface.

FIG. 4 shows a detail view of the latching surface of a member 201 stamped from sheet metal. During the initial portion of the stamping operation, the tool producing the stamping contacts the stock material from the left side as viewed in FIG. 4, moving toward the right. During the initial stage of the stamping operation, the stock material is smoothly deformed. At a certain point, however, the stock material begins to tear. The result is as shown in FIG. 4, where it can be seen that the surface of the stamped material comprises a smooth portion 200 and a rough portion 202. If, without further preparation, such a sheet metal stamping were employed as a latching surface cooperating with a latch member 204, the result would appear as shown in FIG. 5. It can be seen that the rough surface portion 202 is in contact with the latch member. Such a rough surface produces friction, which in turn reduces the sensitivity of the entire circuit breaker in which it is a part. A relatively large amount of moving force upon the latching surface is required before the surface will slide in relation to the latch member. Since this force must be produced by the current responsive means, overall sensitivity of the circuit interrupter is reduced. It is difficult to calculate the exact amount of force while will be required to cause the rough latching surface to move with respect to the latch member. Thus, the accuracy of the entire circuit breaker is also impaired. Prior art circuit interrupters overcame this problem by machining away the rough portion 202 of the latching surface. This produced an acceptably smooth interface between the latch member and the latching surface as is shown in FIG. 6. However, this machining operation served to increase the cost of the entire circuit interrupter.

Figure 7:
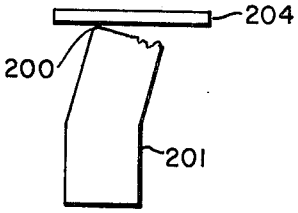
FIG. 7 shows the relationship between a latch member and a stamped sheet metal latching surface employing the teachings of the present invention.

In accordance with the principles of the present invention, the machining operation upon the latching surface can be eliminated by inclining the latching surface with respect to the latch member, as is shown diagrammatically in FIG. 7. In this manner the only point of contact between the latch member and the latching surface is the smooth portion 200. Thus, friction between the latching surface and latch member can be reduced, resulting in an improvement in sensitivity and accuracy of the circuit interrupter.

Figure 8:
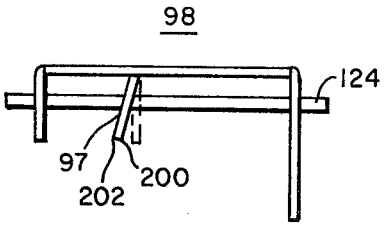
FIG. 8 is a top view of the sheet metal stamping shown in FIG. 3.

A specific embodiment of the invention with respect to the previously described circuit interrupter 20 is shown in FIG. 8. As can be seen therein, the portion 97 of the stamping 98 which includes the latching surface 96 is not perpendicular to the pin 124 (which is the axis of rotation of the portion 97) but is inclined at an angle with respect to the pin 124 and to the rest of the stamping 98. Thus, only the smooth portion 200 of the latching surface 96 is presented for contact with the secondary latch member 92. As the stamping 98 rotates due to the action of the current responsive means 44, the smooth portion 200 of the latching surface 96 remains in contact with the secondary latch member 92.

For certain applications, the primary-secondary latch arrangement is not required. In such applications, the latching surface would cooperate with a single latch member directly connected to the operating mechanism of the circuit breaker. According to the principles of the present invention, the latching surface can be formed of a stamped metal member requiring no further machining operation so long as the latching surface is disposed in relation to the latch member so as to present only the smooth portion of the latching surface for contact with the associated circuit breaker operating mechanism latch member.

It can be seen therefore that the present invention provides a circuit interrupter including a latching surface of stamped metal material which eliminates the machining operation required in prior art stamped metal latching surfaces, thereby achieving a significant cost reduction.

We claim:

1. A circuit interrupter comprising:

separable contacts;

operating means including a releasable latch for effecting separation of said contacts upon release of said latch; and a latching surface contacting and restraining said latch, said latching surface being movable to effect release of said latch and having a rough portion and a smooth portion, said latching surface being disposed in relation to said latch so as to cause only said smooth portion to contact said latch.

2. A circuit interrupter as recited in claim 1 wherein said latch and said latching surface are disposed in sliding contact with each other.

3. A circuit interrupter as recited in claim 2 wherein said latching surface is formed from stamped metal material.

4. A circuit interrupter as recited in claim 3 wherein said latching surface comprises an arcuate surface.

5. A circuit interrupter as recited in claim 4 wherein said arcuate surface comprises a rotating cam surface.

6. A circuit interrupter as recited in claim 5 wherein said operating means comprises a primary latch and a secondary latch, said secondary latch restraining said primary latch and being in sliding contact with said cam surface, rotation of said cam surface being operable to release said secondary latch, thereby releasing said primary latch and actuating said operating means to effect separation of said contacts.

7. A circuit interrupter as recited in claim 5 wherein said cam surface is disposed upon a cam member rotatable about an axis, said cam member being inclined with respect to its axis of rotation so as to cause only said smooth surface portion to contact said latch.

8. Apparatus for latching the operating mechanism of a circuit breaker, comprising:

a latching surface adapted to releasably restrain the latch member of an associated circuit breaker operating mechanism, said latching surface comprising a rough portion and a smooth portion and adapted to present only the smooth portion for contact with an associated circuit breaker operating mechanism latch member.

9. Apparatus as recited in claim 8 wherein said latching surface is formed from stamped metal material.

10. Apparatus as recited in claim 9 wherein said latching surface comprises a rotatable cam member.

11. Apparatus as recited in claim 10 wherein said cam member is inclined at an angle to the axis of rotation of said cam member so as to present only said smooth portion for contact with an associated circuit breaker operating mechanism latch member.

12. In a circuit interrupter of the type having separable contacts and an operating mechanism for initiating separation of said contacts upon release of a latch member, the improvement comprising a stamped metal latching surface movable to release said latch member and having a rough portion and a smooth portion, said latching surface being disposed in relationship to said latch member so as to contact said latch member only with said smooth portion.

13. In a circuit interrupter having separable contacts and a releasable operating mechanism for automatically separating the contacts upon overload current conditions, the operating mechanism having stamped metal latching components, the latching surfaces of which have a rough portion and a smooth portion resulting from the stamping operation; the improvement comprising the disposition of the latching surfaces so that only the smooth portions of the latching surfaces are in contact, whereby the friction between the latching surfaces is reduced without the necessity of a machining operation on the rough portion.

* * * * *